US009255313B2

(12) United States Patent
Cho et al.

(10) Patent No.: US 9,255,313 B2
(45) **Date of Patent: *Feb. 9, 2016**

(54) STEEL SHEET FOR HOT PRESS FORMING HAVING LOW-TEMPERATURE HEAT TREATMENT PROPERTY, METHOD OF MANUFACTURING THE SAME, METHOD OF MANUFACTURING PARTS USING THE SAME, AND PARTS MANUFACTURED BY THE SAME

(75) Inventors: Yeol Rae Cho, Gwangyang (KR); Jin Keun Oh, Gwangyang (KR); Sung Ho Park, Gwangyang (KR)

(73) Assignee: POSCO, Pohang-si (KR)

( * ) Notice: Subject to any disclaimer, the term of this patent is extended or adjusted under 35 U.S.C. 154(b) by 1218 days.

This patent is subject to a terminal disclaimer.

(21) Appl. No.: 12/183,519

(22) Filed: Jul. 31, 2008

(65) Prior Publication Data

US 2009/0238715 A1 Sep. 24, 2009

(30) Foreign Application Priority Data

Mar. 24, 2008 (KR) ..... 10-2008-0026975

(51) Int. Cl.

| | |
|---|---|
| ***C22C 38/06*** | (2006.01) |
| ***C21D 1/48*** | (2006.01) |
| ***C21D 1/673*** | (2006.01) |
| ***C21D 6/00*** | (2006.01) |
| ***C21D 8/02*** | (2006.01) |
| ***C21D 9/46*** | (2006.01) |
| ***C22C 38/00*** | (2006.01) |
| ***C22C 38/04*** | (2006.01) |
| ***C22C 38/12*** | (2006.01) |
| ***C22C 38/14*** | (2006.01) |

(52) U.S. Cl.

CPC . *C22C 38/06* (2013.01); *C21D 1/48* (2013.01); *C21D 1/673* (2013.01); *C21D 6/005* (2013.01); *C21D 8/0226* (2013.01); *C21D 8/0263* (2013.01); *C21D 9/46* (2013.01); *C22C 38/002* (2013.01); *C22C 38/04* (2013.01); *C22C 38/12* (2013.01); *C22C 38/14* (2013.01); *C21D 2211/002* (2013.01); *C21D 2211/005* (2013.01); *C21D 2211/008* (2013.01); *C21D 2211/009* (2013.01); *Y10T 29/49991* (2015.01)

(58) Field of Classification Search

CPC ..... C22C 38/002; C22C 38/04; C22C 38/06; C22C 38/12; C22C 38/14; C21D 1/48; C21D 1/673; C21D 6/005; C21D 8/0226; C21D 8/0263; C21D 9/46; C21D 2211/002; C21D 2211/005; C21D 2211/008; C21D 2211/009; Y10T 29/49991

USPC ..... 420/89, 119, 120; 148/330, 506; 29/527.7

See application file for complete search history.

(56) References Cited

U.S. PATENT DOCUMENTS

| | | | | |
|---|---|---|---|---|
| 5,500,290 | A | 3/1996 | Udagawa et al. | |
| 5,695,576 | A | 12/1997 | Beguinot | |
| 6,296,805 | B1 | 10/2001 | Laurent et al. | |
| 6,398,884 | B1 | 6/2002 | Kyono et al. | |
| 6,632,296 | B2 | 10/2003 | Yoshinaga et al. | |
| 6,699,334 | B2 * | 3/2004 | Yoshii et al. | 148/320 |
| 6,946,038 | B2 | 9/2005 | Jeong et al. | |
| 7,105,066 | B2 | 9/2006 | Jeong et al. | |
| 7,534,312 | B2 | 5/2009 | Yoshinaga et al. | |
| 2001/0042393 | A1 | 11/2001 | Kefferstein et al. | |
| 2004/0238081 | A1 * | 12/2004 | Yoshinaga et al. | 148/603 |
| 2007/0144632 | A1 | 6/2007 | Toyoda et al. | |
| 2008/0110533 | A1 | 5/2008 | Sakamoto | |
| 2009/0095382 | A1 | 4/2009 | Kariya et al. | |

FOREIGN PATENT DOCUMENTS

| | | | |
|---|---|---|---|
| CN | 1099429 | A | 3/1995 |
| CN | 1294637 | A | 5/2001 |
| DE | 69613868 | T2 | 11/2001 |
| EP | 0725156 | A1 | 8/1996 |
| EP | 1143029 | A1 | 10/2001 |
| EP | 1231289 | A1 | 8/2002 |
| EP | 1431407 | A1 | 6/2004 |
| EP | 1693476 | A1 | 8/2006 |
| EP | 1905850 | A1 | 4/2008 |

(Continued)

OTHER PUBLICATIONS

Satou et al., English machine translation of JP 2006-213959, Aug. 2006, whole document.*

*Primary Examiner* — Roy King

*Assistant Examiner* — Caitlin Kiechle

(74) *Attorney, Agent, or Firm* — The Webb Law Firm

(57) ABSTRACT

A steel sheet for forming having low-temperature heat treatment property, in which heat treatment is performed within a range of lower temperature than a conventional steel sheet in the event of hot press forming or post-heat treatment after cold forming, a method of manufacturing the same, and a method of manufacturing parts using the same. The steel sheet has a composition of, by weight, carbon (C): 0.15 to 0.35%, silicon (Si): 0.5% or less, manganese (Mn): 1.5 to 2.2%, phosphorus (P): 0.025% or less, sulfur (S): 0.01% or less, aluminum (Al): 0.01 to 0.05%, nitrogen (N): 50 to 200 ppm, titanium (Ti): 0.005 to 0.05%, tungsten (W): 0.005 to 0.1%, and boron (B): 1 to 50 ppm, wherein Ti/N: less than 3.4, where Ti/N is the atomic ratio of the corresponding elements, Ceq expressed by the following formula ranges from 0.48 to 0.58, and temperature Ar3 ranges from 670° C. to 725° C. Wherein Ceq C+Si/24+Mn/6+Ni/40+Cr/5+V/14 where C, Si, Mn, Ni, Cr and V indicate the contents (wt %) of the respective elements.

28 Claims, 2 Drawing Sheets

(56) References Cited

FOREIGN PATENT DOCUMENTS

| | | | |
|---|---|---|---|
| EP | 1905851 | A1 | 4/2008 |
| GB | 1490535 | A | 11/1977 |
| JP | 53005018 | A | 1/1978 |
| JP | 57126917 | A | 8/1982 |
| JP | 10168542 | A | 6/1998 |
| JP | 11229075 | A | 8/1999 |
| JP | 2003073774 | A | 3/2003 |
| JP | 2006089804 | A | 4/2006 |
| JP | 2006213959 | A | 8/2006 |
| KR | 20020042152 | A | 6/2002 |
| WO | 0244436 | A1 | 6/2002 |
| WO | 03042420 | A1 | 5/2003 |

* cited by examiner

STEEL SHEET FOR HOT PRESS FORMING HAVING LOW-TEMPERATURE HEAT TREATMENT PROPERTY, METHOD OF MANUFACTURING THE SAME, METHOD OF MANUFACTURING PARTS USING THE SAME, AND PARTS MANUFACTURED BY THE SAME

CROSS-REFERENCE TO RELATED APPLICATIONS

This application claims the priority of Korean Patent Application No. 1102008-0026975, filed on Mar. 24, 2008, in the Korean Intellectual Property Office, the disclosure of which is incorporated herein by reference.

BACKGROUND OF THE INVENTION

1. Field of the Invention

The present invention relates to a steel sheet for hot press forming having low-temperature heat treatment property, a method of manufacturing the same, and a method of manufacturing parts using the same, and more particularly, to a steel sheet for forming, in which heat treatment is performed within a range of lower temperature than a conventional steel sheet in the event of hot press forming or post-heat treatment after cold forming, thereby making it possible to solve various problems occurring when the heat treatment is performed at high temperature and to secure sufficient strength, a method for manufacturing the same, and a method of manufacturing impact and structural parts for a motor vehicle.

2. Description of the Related Art

Recently, as motor vehicle safety regulations for passenger protection as well as fuel efficiency restrictions for global environmental protection have become strict, an increasing interest has been taken in the motor vehicle, particularly increasing its rigidity and reducing its weight. For example, in the case in which a variety of parts, such as pillar reinforcements or cross members for a safety cage zone surrounding a passenger compartment, side members for a crash zone, a front or rear bumper, etc., are focused on reducing weight, a high strength steel sheet is inevitably employed in order to secure both the rigidity and the safety against collision.

However, increase of the strength of the steel sheet for the motor vehicle high inevitably leads to problems in that formability is remarkably degraded due to increase in yield strength and decrease in elongation, and in that the dimensions of the parts are changed after forming due to excessive springback, namely the shape fixability is degraded. In order to solve these problems, there have been developed and commercialized the advanced high strength steels (AHSS) such as dual phase (DP) steels having low yield ratio property by introducing a martensite phases into a ferrite matrix and transformation induced plasticity (TRIP) steels having an extremely excellent strength-elongation balance by containing bainite and residual austenite phases in a ferrite matrix as well. And these steels having tensile strength between about 500 MPa and about 1000 MPa have been commercialized. However, they have limitations to meet the requirements of the strength moreover than 1000 MPa of the motor vehicle, i.e. reducing the weight and improving the safety against collision.

Meanwhile, from the viewpoint of the manufacturing of the motor vehicle parts, the higher the strength of material becomes, the higher the forming force is required. Thus, it is necessary to increase capacity of a press. Further, the productivity is lowered due to increased wear and decreased life span of dies caused by high contact pressure. A recently introduced method is called roll forming capable of manufacturing the parts with the forming force less than that of the press forming. However, this roll forming has a problem in that it can be applied only to the parts having a relatively simple shape.

As a method of manufacturing motor vehicle parts having ultra high strength of 1000 MPa or more in order to solve this problem with the formation of the high strength steels, a forming method called hot press forming or hot forming has been commercialized. This forming method is carried out by blanking a steel sheet having tensile strength ranging from 500 MPa to 700 MPa, heating the blanked steel sheet up to an austenite region above $Ac_3$, extracting the heated steel sheet, forming the extracted steel sheet using a press equipped with the die which has cooling system, and die-quenching the formed steel sheet. Thereby, either martensite phases or phases in which martensite and bainite are mixed are finally formed. Thus, such a forming method is a method that can typically obtain the ultra high strength of 1000 MPa or more as well as very high dimensional precision of the parts.

Basic concept of the hot press forming and compositions of the steel used are proposed first in GB1490535. Afterwards, a hot- and cold-rolled steel sheet coated with aluminum or aluminum alloy restricting upper and lower limits of each element, but composition system similar to previous patent, is proposed in U.S. Pat. No. 6,296,805 to inhibit an oxide from forming on the surface of the steel sheet during heating in a hot press forming process. Further, a method of manufacturing hot press formed parts using a galvanized steel sheet which is manufactured by coating a hot rolled steel sheet with zinc or zinc alloy in order to improve corrosion resistance and to inhibit formation of an oxide layer in a heating process, is proposed in EP1143029. Further, Korean Patent Application Publication No. 2002-0042152 discloses a method of manufacturing a galvanized steel sheet for hot press forming.

However, as described above, the conventional steel sheets for the hot press forming are heat-treated steel sheets having a composition system in which titanium and chromium are added in common on the basis of a composition system of 22MnB5, i.e. 0.22% of C-1.2% of Mn-maximum 50 ppm of B, specified in EN standards. In order to obtain tensile strength of about 1500 MPa after heat treatment, it is necessary to typically heat these steel sheets at a temperature of 900° C. or more. However, the thinner the hot press formed part becomes, the faster the temperature of the blank extracted from a heating furnace is lowered. Thus, a possibility that the strength of a final hot press formed part is to be reduced is increased. In other words, if any material becomes thin, radiant heat capacity thereof is increased. As such, before the hot press forming is carried out after the blank is extracted from the heating furnace, cooling has already occurred excessively, and thus a possibility that ferrite is to be formed on a superficial layer is increased. For this reason, the strength of the final part is reduced. In contrast, in order to maintain the temperature of the entire material within the austenite region when the hot press forming is carried out, heating temperature must be additionally increased. However, if the heating temperature is increased, various problems additionally take place as follows. In detail, in the case of hot rolled steel sheets or cold rolled steel sheets, the thickness of a superficial oxide scale is increased during heating, the scales stripped off by the hot press forming are picked up on the surface of die, and thus the surface quality of the final part can be deteriorated.

In addition, in the case of galvanized steel sheets, when the steel sheet is heated, some of zinc is evaporated. In order to prevent this evaporation, JP2003-073774 discloses a method of forming a zinc oxide barrier layer during heating for the hot press forming. However, as described above, when the heating temperature is increased, the zinc oxide layer is non-uniformly formed, and thus the surface quality of the final part is also deteriorated. Further, in the case of aluminum coated steel sheets, when the heating temperature is increased, the thickness of aluminum oxide is increased. Further, while the hot press forming is carried out, there is a high possibility that the thickened aluminum oxides are stripped off and picked up on the die surface. Consequently, in the case of any steel sheet used at the hot press forming, when the heating temperature is increased, the surface quality of the final part is deteriorated. In addition, the heating cost is increased.

Further, in the case of a method of performing post-heat treatment in order to improve strength of the steel sheet going through the cold press forming rather than the hot press forming, it is preferable to decrease the heating temperature from the viewpoint of the cost of production.

SUMMARY OF THE INVENTION

The present invention has been made to solve the foregoing problems with the prior art, and therefore the present invention is directed to a steel sheet for hot press forming or post-heat treatment, a method of manufacturing the same, and a method of manufacturing parts using the same, based on a new idea capable of easily obtaining tensile strength of 1470 MPa or more after hot press forming or post-heat treatment although heating is carried out at a lower temperature compared to the related art, and additionally increasing yield strength in the process of baking heat treatment.

Here, the hot press forming refers to a forming process of carrying out forming after heating, and then die quenching, and the post-heat treatment refers to subsequent heat treatment such as high-frequency induction heating or furnace heating applied additionally after cold forming.

An aspect of the present invention is to provide a steel sheet for hot press forming, which includes, by weight, carbon (C): 0.15 to 0.35%; silicon (Si): 0.5% or less; manganese (Mn): 1.5 to 2.2%; phosphorus (P): 0.025% or less; sulfur (S): 0.01% or less; aluminum (Al): 0.01 to 0.05%; nitrogen (N): 50 to 200 ppm; titanium (Ti): 0.005 to 0.05%; tungsten (W): 0.005 to 0.1%; and boron (B): 1 to 50 ppm, wherein Ti/N: less than 3.4, where Ti/N is the atomic ratio of the corresponding elements, Ceq expressed by the following formula ranges from 0.48 to 0.58, and temperature Ar3 ranges from 670° C. to 725° C.

$$Ceq=C+Si/24+Mn/6+Ni/40+Cr/5+V/14 \quad \text{[Formula]}$$

where C, Si, Mn, Ni, Cr and V indicate the contents (wt %) of the respective elements.

$$Ar3=910-310C-80Mn-20Cu-55Ni: 670 \text{ to } 725^\circ \text{ C.}$$

where C, Mn, Cu and Ni indicate the contents (wt %) of the respective elements.

Here, the steel sheet may further include at least one selected from the group consisting of by weight: niobium (Nb): 0.005 to 0.1%; vanadium (V): 0.005 to 0.1%; copper (Cu): 0.1 to 10.0; and nickel (Ni): 0.05 to 0.5%.

Further, the steel sheet may have microstructure having ferrite and pearlite phases.

According to an aspect of the present invention, there is provided a method of manufacturing a hot rolled steel sheet for hot press forming, which includes: heating a steel slab to a temperature from 1150° C. to 1250° C., the steel slab having a composition of, by weight, carbon (C): 0.15 to 0.35%, silicon (Si): 0.5% or less, manganese (Mn): 1.5 to 2.2%, phosphorus (P): 0.025% or less, sulfur (S): 0.01% or less, aluminum (Al): 0.01 to 0.05%, nitrogen (N): 50 to 200 ppm, titanium (Ti): 0.005 to 0.05%, tungsten (W): 0.005 to 0.1%, and boron (B): 1 to 50 ppm, wherein Ti/N: less than 3.4, where Ti/N is the atomic ratio of the corresponding elements, Ceq expressed by the following formula ranges from 0.48 to 0.58, and temperature Ar3 ranges from 670° C. to 725° C.; and rolling the heated steel slab via the roughing and finishing mill process to manufacture the steel sheet, wherein the finishing mill process includes: rolling the steel sheet at a temperature of Ar3 or more; and cooling and coiling the steel sheet at a temperature from 600° C. to 700° C.

$$Ceq=C+Si/24+Mn/6+Ni/40+Cr/5+V/14 \quad \text{[Formula]}$$

where C, Si, Mn, Ni, Cr and V indicate the contents (wt %) of the respective elements.

Here, the steel slab may further include at least one selected from the group consisting of by weight: niobium (Nb): 0.005 to 0.1%; vanadium (V): 0.005 to 0.1%; copper (Cu): 0.1 to 1.0%; and nickel (Ni): 0.05 to 0.5%.

According to an aspect of the present invention, there is provided a method of manufacturing a cold rolled steel sheet for hot press forming, which includes: pickling a hot rolled steel sheet, hot rolled steel sheet having a composition of, by weight, carbon (C): 0.15 to 0.35%, silicon (Si): 0.5% or less, manganese (Mn): 1.5 to 2.2%, phosphorus (P): 0.025% or less, sulfur (S): 0.01% or less, aluminum (Al): 0.01 to 0.05%, nitrogen (N): 50 to 200 ppm, titanium (Ti): 0.005 to 0.05%, tungsten (W): 0.005 to 0.1%, and boron (B): 1 to 50 ppm, wherein Ti/N: less than 3.4, where Ti/N is the atomic ratio of the corresponding elements, Ceq expressed by the following formula ranges from 0.48 to 0.58, and temperature Ar3 ranges from 670° C. to 725° C.; cold-rolling the pickled steel sheet to manufacture full hard steel sheet; and continuously annealing the full hard steel sheet, wherein, when the temperature of continuous annealing is controlled to be within a range of 750° C. to 850° C., and temperature of a following over aging section is controlled to be within a range of 450° C. to 600° C.

$$Ceg=C+Si/24+Mn/6+Ni/40+Cr/5+V/14 \quad \text{[Formula]}$$

where C, Si, Mn, Ni, Cr and V indicate the contents (wt %) of the respective elements.

Here, the hot rolled steel sheet further comprises at least one selected from the group consisting of by weight: niobium (Nb): 0.005 to 0.1%; vanadium (V) 0.005 to 0.1%; copper (Cu): 0.1 to 1.0%; and nickel (Ni): 0.05 to 0.5%.

Further, the method may be performed by one selected from hot galvanizing, zinc electroplating and zinc-iron electroplating.

According to an aspect of the present invention, there is provided a method of manufacturing an aluminum coated steel sheet for hot press forming, which includes: pickling a hot rolled steel sheet, the hot rolled steel sheet having a composition of, by weight, carbon (C): 0.15 to 0.35%, silicon (Si): 0.5% or less, manganese (Mn): 1.5 to 2.2%, phosphorus (P): 0.025% or less, sulfur (S): 0.01% or less, aluminum (Al): 0.01 to 0.05%, nitrogen (N): 50 to 200 ppm, titanium (Ti): 0.005 to 0.05%, tungsten (W) 0.005 to 0.1%, and boron (B): 1 to 50 ppm, wherein Ti/N: less than 3.4, where Ti/N is the atomic ratio of the corresponding elements, Ceq expressed by the following formula ranges from 0.48 to 0.58, and temperature Ar3 ranges from 670° C. to 725° C.; cold-rolling the pickled steel sheet to manufacture full hard steel sheet; and annealing the full hard steel sheet at a temperature from 750° C. to 850° C.; and dipping the annealed steel sheet in hot metal bath containing an aluminum or aluminum alloy to form a coated steel sheet, and then cooling the coated steel sheet to room temperature at a cooling rate from 5° C./sec to 15° C./sec.

$$Ceq=C+Si/24+Mn/6+Ni/40+Cr/5+V/14 \quad \text{[Formula]}$$

where C, Si, Mn, Ni, Cr and V indicate the contents (wt %) of the respective elements.

Here, the aluminum coated steel sheet may further include at least one selected from the group consisting of by weight: niobium (Nb): 0.005 to 0.1%; vanadium (V): 0.005 to 0.1%; copper (Cu): 0.1 to 1.0%; and nickel (Ni): 0.05 to 0.5%.

According to an aspect of the present invention, there is provided a method of manufacturing parts, which includes: preparing a blank made of a steel sheet for hot press forming, the steel sheet having a composition of, by weight, carbon (C) 0.15 to 0.35%, silicon (Si): 0.5% or less, manganese (Mn): 1.5 to 2.2%, phosphorus (P): 0.025% or less, sulfur (S): 0.01% or less, aluminum (Al) 0.01 to 0.05%, nitrogen (N): 50 to 200 ppm, titanium (Ti): 0.005 to 0.05%, tungsten (W): 0.005 to 0.1%, and boron (S): 1 to 50 ppm, wherein Ti/N: less than 3.4, where Ti/N is the atomic ratio of the corresponding elements, Ceq expressed by the following formula ranges from 0.48 to 0.58, and temperature Ar3 ranges from 670° C. to 725° C.; heating the blank at a temperature of 820° C. to 950° C.; maintaining the heated blank for 60 seconds or more, and extracting the maintained blank; transferring the extracted blank to a press equipped with die (s) and performing the hot press forming; and die-quenching to the temperature of 2000 or less at a cooling rate of 20° C./sec or more.

$$Ceq=C+Si/24+Mn/6+Ni/40+Cr/5+V/14 \quad \text{[Formula]}$$

where C, Si, Mn, Ni, Cr and V indicate the contents (wt %) of the respective elements.

According to an aspect of the present invention, there is provided a method of manufacturing parts, which includes: preparing a blank or a tube made of a steel sheet for post-heat treatment, the steel sheet having a composition of, by weight, carbon (C): 0.15 to 0.35%, silicon (Si): 0.5% or less, manganese (Mn): 1.5 to 2.2%, phosphorus (P): 0.025% or less, sulfur (S) 0.01% or less, aluminum (Al): 0.01 to 0.05%, nitrogen (N): 50 to 200 ppm, titanium (Ti): 0.005 to 0.05°, tungsten (W): 0.005 to 0.1%, and boron (B): 1 to 50 ppm, wherein Ti/N: less than 3.4, where Ti/N is the atomic ratio of the corresponding elements, Ceq expressed by the following formula ranges from 0.48 to 0.58, and temperature Ar3 ranges from 670° C. to 725° C.; and cold-forming the prepared blank or tube into pre-formed shape of the part, heating the pre-formed shape of part at a temperature of 820° C. to 950° C.; maintaining the pre-formed shape of part for 60 seconds or more; and extracting the pre-formed shape of part; and hot press forming the pre-formed shape of part into the final shape of part, if necessary; and quenching the part with die-quenching or a coolant to the temperature of 200° C. or less at a cooling rate of 20° C./sec or more.

$$Ceq=C+Si/24+Mn/6+Ni/40+Cr/5+V/14 \quad \text{[Formula]}$$

where C, Si, Mn, Ni, Cr and V indicate the contents (wt %) of the respective elements.

Here, the steel sheet for forming may further include at least one selected from the group consisting of by weight: niobium (Nb): 0.005 to 0.1%; vanadium (V): 0.005 to 0.1%; copper (Cu): 0.1 to 1.0%; and nickel (Ni): 0.05 to 0.5%.

According to an aspect of the present invention, there is provided structural part for motor vehicle, which is manufactured by hot press forming; and hot press forming after the preliminary cold forming, or post-heat treatment after cold forming, in which: the steel sheet has a composition of, by weight, carbon (C): 0.15 to 0.35%, silicon (Si): 0.5% or less, manganese (Mn): 1.5 to 2.2%, phosphorus (P): 0.025% or less, sulfur (S): 0.01% or less, aluminum (Al): 0.01 to 0.05%, nitrogen (N): 50 to 20 ppm, titanium (Ti): 0.005 to 0.05%, tungsten (W): 0.005 to 0.1%, and boron (B): 1 to 50 ppm, wherein Ti/N: 3.4 less than less, where Ti/N is the atomic ratio of the corresponding elements, Ceq expressed by the following formula ranges from 0.48 to 0.58, and temperature Ar3 ranges from 670° C. to 725° C.; and a final structure of the steel sheet includes, by area fraction, martensite of 90% or more, and the balance of at least one selected from bainite and ferrite.

$$Ceq=C+Si/24+Mn/6+Ni/40+Cr/S+V/14 \quad \text{[Formula]}$$

where C, Si, Mn, Ni, Cr and V indicate the contents (wt %) of the respective elements.

The hot rolled steel sheet, the cold rolled steel sheet, and the coated steel sheet according to the present invention have high carbon equivalent weights, compared to a steel sheet for hot press forming commercialized in the related art. As such, although the steel sheet is heated at low temperature after the hot press forming or the cold forming is performed, it is possible to easily obtain tensile strength of 1470 MPa or more, to reduce deviation of mechanical properties, and to additionally increase yield strength in a painting heat-treatment process after the heat treatment. Thus, when the parts for hot press forming are manufactured, it is possible to reduce energy consumption, and strength uniformity and collision performance of the impact and structural members for the motor vehicle can be remarkably improved.

BRIEF DESCRIPTION OF THE DRAWINGS

The above and other aspects, features and other advantages of the present invention will be more clearly understood from the following detailed description taken in conjunction with the accompanying drawings, in which.

DETAILED DESCRIPTION OF THE EXEMPLARY EMBODIMENTS

Figure 1:
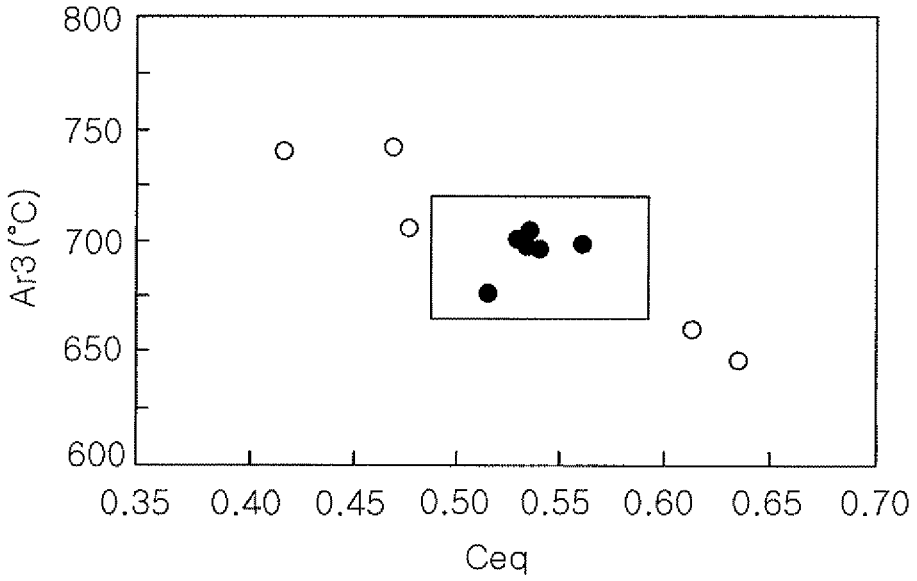
FIG. 1 is a graph depicting relation between Ar3 and Ceq in an alloy composition according to the present invention.

Exemplary embodiments of the present invention will now be described in detail with reference to the accompanying drawings.

In order to solve the abovementioned problems, the present inventors have found the following results via the deep studies thereof, and have devised the present invention.

As set forth above, the steel sheet for the motor vehicle require that its final product has strength of 1470 MPa or more in order to increase fuel efficiency and thus make a body of the motor vehicle lightweight. To this end, it is required that, after hot press forming, the microstructure of manufactured part is regulated to have a martensite as a major phase, as well as that a higher content of nitrogen is contained in order to further strengthen the part, compared to the related art.

However, it is preferable that the strength of the steel sheet before pre-forming or blanking be maintained below a certain level. This is because, if the strength of the steel sheet is too high, it is difficult to perform the pressing or blanking itself of the steel sheet, and dimensional precision is reduced due to springback or the like.

Especially, in the case in which the hot press forming is performed on a thin material, the temperature has to be higher than temperature, i.e., Ar3, at which austenite is transformed into ferrite. Further, this temperature is in reverse proportion to the thickness. Thus, the thinner the material becomes, the higher the heating temperature of the material is required. In the case of the thin material, energy consumption is relatively increased, and various problems may occur due to the high temperature heating. In order to solve those problems, a composition system of the steel sheet is preferably adjusted to a composition system which can further lower the temperature Ar3, at which austenite is transformed into ferrite, compared to the prior art.

Further, in order to secure toughness of the steel sheet for forming, the steel sheet is preferably processed so as not only to have a finer microstructure but also prevent a brittle structure as far as possible. To this end, it is more preferable that the composition of the steel sheet be regulated to a proper range, and the steel sheet be manufactured using an adequate manufacturing method as well.

To this end, the present invention is characterized in that the alloy composition of the steel sheet is regulated to be within a specified range as follows, and that a process condition is improved suitably to the steel sheet of the invention as follows. The composition range of the steel sheet will now be described.

That is, the steel sheet according to the present invention comprises: by weight, carbon (C); 0.15 to 0.35%; silicon (Si): 0.5% or less; manganese (Mn) 1.5 to 2.2%; phosphorus (P): 0.025% or less; sulfur (S): 0.01% or less; aluminum (Al): 0.01 to 0.05%; nitrogen (N): 50 to 200 ppm; titanium (Ti): 0.005 to 0.05%; tungsten (W): 0.005 to 0.1%; and boron (B): 1 to 50 ppm, wherein Ti/N: 3.4 or less, where Ti/N is the atomic ratio of the corresponding elements, Ceq expressed by the following formula 1 ranges from 0.48 to 0.58, and temperature Ar3 ranges from 670° C. to 725° C.

$$Ceq=C+Si/24+Mn/6+Ni/40+Cr/5+V/14 \quad \text{[Formula 1]}$$

where C, Si, Mn, Ni, Cr and V indicate the contents (wt %) of the respective elements.

Herein, in order to further improve mechanical properties of the steel sheet, preferably, the steel sheet further includes at least one selected from the group consisting of by weight: niobium (Nb): 0.005 to 0.1%; vanadium (V): 0.005 to 0.1%; copper (Cu): 0.1 to 1.0%; and nickel (Ni): 0.05 to 0.5%.

In the steel sheet having the above composition, instead of adding an element such as Cr or so on, the content of Mn, which has a remarkable retarding effect of transformation from austenite to ferrite, is further increased compared to the conventional art, and the contents of the other elements are regulated, so that upon cooling, a austenite-to-ferrite transformation temperature is lowered. This prevents, upon heat treatment, the strength from being reduced due to ferrite transformation even though the temperature, extracted from a heating furnace, is not high. Further, this also makes it possible to have a sufficient proportion of martensite in a product, which is manufactured by the hot press forming, above a certain level, since a so-called hardenability improving element, which facilitates creating the martensite in the event of cooling, is added. Furthermore, nitrogen remaining after the formation of nitride serves to additionally secure strength when the manufactured product is post-processed.

Hereinafter, a description will be made of the limitations to the composition of the steel sheet.

Carbon: 0.15 to 0.35 wt %

Carbon (C) is a representative element of increasing the strength of the steel sheet. In particular, the strength of a martensite structure, which is obtained when being quenched after heat treatment as in the hot press forming, has a strong tendency to be proportional to the amount of carbon. Further, if the content of carbon decreases, the temperature Ac3 increases. Furthermore, the full austenitization is restricted by the low temperature heating according to the present invention. For this reason, a lower limit of carbon is 0.15 wt %. Further, if the content of carbon exceeds 0.35 wt %, weldability deteriorates, and the strengths of a hot rolled steel sheet, cold rolled steel sheet and a coated steel sheet become 750 Mpa or more, resulting in reduction in shortage of lifetime of a pre-forming or a blanking die. Therefore, an upper limit of carbon is restricted to 0.35 wt %.

Silicon: 0.5 wt % or Less

Silicon (Si) is a solid solution strengthening element, which is effective for increasing strength. However, since Si increases the temperature Ac3 and therefore the heating temperature inevitably to be increased, an upper limit of Si is restricted to 0.5 wt %. Meanwhile, a lower limit of Si does not need to be particularly considered. However, if the content of Si is excessively reduced in order to remove Si from steel, the manufacturing cost becomes increased. Taking this restriction into consideration, the lower limit is preferably set to 0.01 wt %.

Manganese: 1.5 to 2.2 wt %

Manganese (Mn) is a solid solution strengthening element, and is a representative element which makes a great contribution to increasing the strength and to decreasing the temperature Ar3. Further, Mn has an excellent effect improving the hardenability of steel by inhibiting transformation from austenite to ferrite, so that Mn is a very important element in the present invention. Since the effect becomes outstanding when the content of Mn is 15 wt % or more, the lower limit of Mn is restricted to 1.5 wt %. On the contrary, if Mn exceeds 2.2 wt %, weldability is deteriorated, and the strengths of a hot rolled or cold rolled steel sheet and a coated steel sheet become 750 MPa or more. This leads to reducing the lifetime of a preforming or a blanking die. Therefore, an upper limit of Mn is restricted to 2.2 wt %.

Phosphorus: 0.025 wt % or Less

Phosphorus (P) serves to increase the strength like silicon. Further, P increases the temperature Ar3, contributes to slab segregation in the case of continuous casting, and deteriorates the weldability. Thus, P is restricted to 0.025 wt % or less.

Sulfur: 0.01 wt % or Less

Sulfur (S) serves as an impurity element in steel. If S is bonded with manganese in steel, and thereby exists in the form of sulfide, this sulfide not only deteriorates hot ductility to cause surface defects, but also possibly deteriorates the weldability. Thus, the content of S is restricted to 0.01 wt % or less.

Aluminum: 0.01 to 0.05 wt %

Aluminum (Al) is a representative element used as deoxidizer, which generally has the content of 0.01 wt % or more, which suffices for the usual purpose. However, Al increases the temperature Ar3 and therefore the heating temperature. Particularly, excess Al, remaining in the greater amount than required for the deoxidization, is bonded with nitrogen, thereby reducing the amount of nitrogen resolved in steel, thereby inhibiting an increase in the yield strength after baking process, which is attributed to the addition of nitrogen according to the present invention. Thus, the content of Al is restricted to 0.05 wt % or less.

Nitrogen: 50 to 200 ppm

Nitrogen (N) is an element that contributes to the solid solution hardening as in the case of carbon and the bake hardening. The present invention is characterized in that N is added so as to basically contain resolved N. N is added in the amount of 50 ppm or more, in consideration of the effects of an increase in the strength of the martensite, obtained after hot press forming, and of an increase in the yield strength after baking process. On the contrary, if N is excessively added, N contributes to the deterioration in the performance of continuous casting and to the creation of corner-cracks of the continuous cast slab. Thus, the upper limit thereof is restricted to 200 ppm, preferably 50 to 150 ppm and more preferably 50 to 100 ppm.

Titanium: 0.005 to 0.05 wt %

Titanium (Ti) is added in the amount of 0.005 wt % or more in order to restrict the grain growth of austenite in the process of heating in the hot press forming by means of titanium carbonitride. However, if Ti is excessively added, the amount of resolved nitrogen is reduced to deteriorate the hardenability that the present invention intends to achieve, and the amount of resolved nitrogen, effective for an increase in the yield strength during baking heat treatment, also is reduced. Thus, the upper limit thereof is restricted to 0.05 wt %.

Tungsten: 0.005 to 0.1 wt %

Tungsten (W) is an element that is effective for an increase in the strength of the steel sheet. The tungsten carbide restricts the grain growth of austenite, and refines the grains after hot press forming, thereby having an effect increasing toughness. Thus, W is an important element in the present invention. When the content of W is below 0.005 wt %, the above effect cannot be expected. Further, when the content of W exceeds 0.1 wt %, the effect of addition is saturated, and the manufacturing cost is increased. Thus, the upper limit of W is restricted to 0.1 wt %.

Boron: 1 to 50 ppm

Boron (B) is a very effective element for an increase in hardenability of heat treated steel. Even the smallest trace thereof greatly contributes to an increase of the strength of the heat treated steel. Thus, the lower limit of B is preferably 1 ppm. However, as the amount of addition increases, the effect of increasing the hardenability, in contrast with the amount of addition, becomes weak, and defects may occur in the corner of the continuous casting slab. Further, according to the present invention, nitrogen has to be resolved, in consideration of the effects of increasing the strength of martensite, obtained after hot press forming, and of increasing the yield strength after baking. Thus, the upper limit of B is restricted to 50 ppm, and preferably, 1 to 30 ppm.

Further, when taking account of the effects on mechanical properties of the steel sheet or thermodynamic behaviors between the respective elements, it is preferable that, in addition to the compositions of the above respective elements, Ti/N, Ceq, and Ar3 be controlled as in the following conditions.

Ti/N: Below 3.4 (where Ti/N is the Atomic Ratio of the Corresponding Elements)

As set forth above, titanium and nitrogen form titanium (carbo) nitride to restrict the grain growth, thereby making the microstructure of the steel sheet finer. It is general that the content control is carried out such that the composition is composed of surplus titanium, added more than required, in order to use the precipitate as it is, without employing nitrogen in the state of solid solution as far as possible. In this case, a value of Ti/N generally becomes 3.4 or more. However, according to the present invention, the atomic ratio of Ti/N is set to 3.4 or less in order to contain the effective solute nitrogen and then use the same for a further increase in strength after baking heat treatment. That is, while the conventional boron-added steel is processed such that the content of nitrogen is reduced to the maximum in order to increase the effective solute boron, the present invention adopts the method to increase the content of nitrogen. This is because the present inventors have found that, even in the case of the occurrence of an increase in the content of nitrogen, if the composition is controlled as in the present invention, remaining solute nitrogen exists, so that the hardenability increases to contribute to an increase in the strength of the product after hot press forming and the provision of an effect of bake hardening thanks to solute nitrogen in the process of baking heat treatment of the product.

Further, since BN precipitate, created due to surplus nitrogen, is decomposed at lower temperature than TiN, the material, which is subjected to the hot press forming or the post heat treatment after cold forming as in the present invention, is dissolved in the steel during heating, so that the hardenability of the steel can be increased.

$$Ceq=C+Si/24+Mn/6+Ni/40+Cr/5+V/14: 0.48 \text{ to } 0.58$$

Ceq means carbon equivalent, which is indicated as values of respective alloy elements with respect to the behavior of carbon, as a single index, wherein the respective alloy elements are weighed according to the degree that they are of similar behavior to carbon. Ceq is widely used as an index of weldability, generally. Thus, it is required to control the content of Ceq because in the present invention, there is often the case in which the product, manufactured by forming, is used after being welded. However, according to the present invention, within the range of Ceq, required for securing the weldability, the range of Ceq is further restricted so as to secure the proper range of strength and the sufficiently-wide area of austenite. That is, if the content of Ceq is excessive, the strength of the hot- or cold rolled steel sheet or the coated steel sheet is so high that upon forming, in particular upon manufacturing a blank in a blanking process, a die is problematically over-loaded so that the lifetime thereof is reduced. Conversely, if the content of Ceq is too low, the strength of a final product may not suffice for the use purpose. Further, as shown in FIG. 1, in the alloy system of the present invention, Ceq also has a great effect on the Ar3 temperature, which lies within a range of 670 to 725° C., preferably. However, if the range of Ceq is controlled to be within a range of 0.48 to 0.58, it is easy to control the Ar3 temperature to be within the above preferable range.

$$Ar3=910-310C-80Mn-20Cu-55Ni: 670 \text{ to } 725^\circ C.$$

As described before, Ar3 is the temperature point at which, when the steel material is cooled after being heated, the microstructure thereof starts the transformation from austenite to ferrite. As the Ar3 temperature decreases, the temperature range of the area of the austenite of the steel material becomes wider and lower. Ar3 of the conventional steel sheet for forming is approximately 760° C., which upon hot press forming thinner gauged sheet material, may cause the reduction in strength or quality thereof. According to the present invention, the composition range of the alloy is restricted, and the temperature range of Ar3 is restricted to the above range of 670 to 725° C. as well. Herein, it is preferable that the temperature range of Ar3 be controllable without making a repeated experiment too many times. To this end, the present invention determines the value, using a formula, empirically effective from the relationship between Ar3 and the composition of the alloy. In the formula, C, Mn, Cu, Ni and the like indicate the contents (wt %) of the respective corresponding elements.

As also set forth above, in order to further improve the characteristic of the steel sheet, the steel sheet may further comprise at least one of the following alloy elements, in addition to the above-mentioned composition.

Niobium: 0.005 to 0.1 wt %

Niobium (Nb) is an element, effective for an increase in the strength and toughness of the steel sheet, and grain refinement. Further, Nb restricts the grain growth in the process of re-heating, and thus is effective for the delay of a transformation between austenite and ferrite in the process of cooling. However, if the content is below 0.005 wt %, it is not expected to obtain the above effect. Conversely, if the content exceeds 0.1 wt %, it is possible to deteriorate workability and create delayed fracture due to the excessive formation of carbonitride. Thus, the upper limit of Nb is restricted to 0.1 wt %.

Vanadium: 0.005 to 0.1 wt %

Vanadium (V) is effective for an increase in the strength and hardenability of the steel sheet, and grain refinement. However, if the content of V is below 0.005 wt %, the above-mentioned effect cannot be expected. Further, if the content of V exceeds 0.1 wt %, it is possible to deteriorate workability and create delayed fracture due to the excessive formation of carbonitride. Thus, the upper limit of V is restricted to 0.1 wt %.

Copper: 0.1 to 1.0 wt %

Copper (Cu) is an element, effective for an increase in the strength as well as hardenability of the steel sheet. Further, when carrying out a tempering process after hot press forming for an increase in toughness, supersaturated copper is precipitated as epsilon carbide, providing the effect of age hardening. However, if the content of Cu is below 0.1 wt %, no effect can be expected, so that the lower limit of Cu is restricted to 0.1 wt %. Because the Ac3 temperature decreases as the added amount of Cu increases, Cu may lower the heating temperature in the hot press forming, and it also is expected to obtain the effect of age hardening. However, if the content of Cu exceeds 1.0 wt %, the above tendency is saturated and the manufacturing cost is uneconomic, so that the upper limit of Cu is restricted to 1.0 wt %.

Nickel: 0.05 to 0.5 wt %

Nickel (Ni) is effective for an increase in the strength, toughness, and hardenability of the steel sheet. Further, Ni is also effective for reduction in susceptibility to hot shortening, caused by the addition of copper only. Because the defect can be avoided if nickel is generally added in a half level of the added amount of Cu, the lower and upper limits of Ni are restricted to 0.05 wt % and 0.5 wt %, respectively.

The steel sheet of the present invention as composed above can be used in the form of hot- or cold-rolled steel sheet, or otherwise be used in the state of being surface-coated, if needed. The coating treatment is performed to prevent the surface oxidization of the steel sheet and improve corrosion resistance of hot press formed part. The steel sheet may be manufactured by means of hot-dip galvanizing or electrogalvanizing, and hot-dip aluminizing. The hot-dip aluminizing and galvanizing layers may contain alloy elements.

Further, it is preferable that the steel sheet do not substantially have a low temperature microstructure, such as martensite or bainite. That is to say, it is advantageous that the steel sheet has the strength of 750 MPa or less in an aspect of pre-forming or blanking. If the steel sheet contains the low temperature microstructure, such as the martensite or the bainite, the strength is increased, and therefore a die, including a blanking die, may suffer wear and damage. Thus, it is preferable that the steel sheet have the microstructure of ferrite and pearlite.

The steel sheet of the present invention, having the above advantageous condition, is preferably manufactured into a hot rolled steel sheet, a cold rolled steel sheet, a zinc coated steel sheet, or an aluminum coated steel sheet, by the following process.

First, a description will now be made of a process of manufacturing the hot rolled steel sheet.

The hot rolled steel sheet is manufactured by the steps of: heating a steel slab, satisfying the above-mentioned composition range, to a range of 1150 to 1250° C.; rolling the heated steel slab via a roughing mill process and a finishing mill process to form a steel sheet, wherein the finishing mill process is performed above Ar3 temperature; and cooling the steel sheet to a temperature range of 600 to 700° C., and coiling the same. The other conditions, which are not described above, can be set to those according to the common manufacturing method, so that the details will not be particularly described because one skilled in the art can easily draw an analogy without making a repeated experiment too many times by using the knowledge in the art.

The reason why to heat the steel slab to the range of 1150 to 1250° C. is to homogenize the structure of the slab, render the elements, such as Ti, Nb, or V, re-resolved sufficiently, and prevent the excessive grain growth of the slab.

The finishing mill process is performed above the Ar3 temperature, preferably. In the case that the temperature during the finishing mill process is excessively low, since the hot rolling is processed at two-phase zone (coexisting zone including ferrite and austenite), in which a portion of austenite already has been transformed into ferrite, the deformation resistance becomes inhomogeneous to deteriorate the rolling threading. Further, if stress is concentrated on the ferrite, fracture may be possibly created on the strip, which is not preferable. Further, in order to render the steel sheet consisting of only the ferrite and pearlite without including the low temperature transformed microstructure, the coiling temperature is within the range of 600 to 700° C., preferably. If the winding temperature is too low, the low temperature transformed microstructure, such as martensite and/or bainite, is easy to develop, which is not preferable.

The hot rolled steel sheet, manufactured by the above process, may be used for the product of hot press forming or post heat treatment after cold forming process, or otherwise be used for manufacturing a cold steel sheet or a coated steel sheet via the subsequent cold rolling or coating process.

Herein, the cold rolled steel sheet is manufactured by the steps of: pickling the hot rolled steel sheet manufactured by the above process; cold-rolling the pickled steel sheet to form full hard steel sheet; and continuously annealing the full hard steel sheet, wherein upon the continuous-annealing, the annealing temperature is controlled to be within a range of 750 to 850° C., and the temperature of following over aging section is controlled to be within a range of 450 to 600° C.

That is, it is general that the continuous-annealing is performed by the steps of heating the cold rolled steel sheet (full hard material) to annealing temperature, conducting a slow cooling step to perform primary-cooling, and performing secondary-cooling to over aging temperature, wherein the annealing temperature of 750 to 850° C. means the temperature range to soak the steel sheet, and the over aging temperature means the temperature, which is maintained after the secondary-cooling of steel sheet.

If the annealing temperature is too low, recrystallization, which is the purpose of the annealing, may not suffice. Conversely, if the annealing temperature is too high, pinning effect, caused by the precipitates, is reduced, so that austenite grains are possibly coarsened, which is not preferable to get fine uniform microstructure.

Further, the temperature in the over aging section is for determining a final structure of the steel sheet. If the temperature in the over aging section is too low, the low temperature structure, such as the martensite and the bainite, may be formed, which is not preferable. Conversely, if the temperature is too high, energy consumption increases, which is uneconomic. The temperature and cooling rate in cooling step before the over aging may be applied within the range, which can be easily changeable by one skilled in the art.

The zinc coated steel sheet can be manufactured by galvanizing or galvannealing the cold rolled steel sheet manufactured by the above process. For zinc coating, the hot dipping galvanizing method and the electroplating method all may be used. In particular, the electroplating may use Zn-electroplating or Zn—Fe electroplating method in a continuous-electroplating line.

Further, the aluminum coated steel sheet may be manufactured by the steps of: pickling the hot rolled steel sheet, manufactured by the above process; cold-rolling the pickled steel sheet to form full hard steel sheet; annealing the full hard steel sheet at a temperature from 750 to 850° C.; and dipping the annealed steel sheet in hot aluminum or aluminum alloy bath so as to cool the same to room temperature at a cooling rate within a range of 5 to 15° C./sec.

Herein, if the temperature to heat the full hard steel sheet (material) is too high, grain coarsening may disadvantageously occur. Conversely, if it is too low, recrystallization is not sufficient, so that the annealing effect cannot be obtained.

Further, in order to control the cooling rate of the steel sheet, dipped in the hot aluminum bath, to be slow, the threading speed of the steel sheet is made slow, so that productivity is degraded, a pick-up defect of hot-dip aluminized layer occurs on the surface of the steel sheet due to the low cooling rate, which is not preferable. Conversely, if the cooling rate is too high, the low temperature structure, such as the martensite and the bainite, is created, and therefore the strength of the coated steel sheet is increased, having an influence on shortage in lifetime of a die, such as a blanking die, which is not preferable.

The hot rolled steel sheet, the cold rolled steel sheet, the zinc coated steel sheet or the aluminum coated steel sheet, manufactured by the above process, may be manufactured into parts for automobile or the like by the following forming process after the provision of a proper blank. The forming process using the steel sheet for forming will now be described in detail.

The hot press forming method includes the step of: preparing a blank made of the steel sheet for forming; heating the blank at a temperature from 820 to 950° C.; maintaining the heated blank for 60 seconds or more, and extracting the same; transferring the extracted blank into press equipped with hot press forming tool, and performing hot press forming on the transferred blank; and cooling the hot formed part to a temperature of 200° C. or less at a cooling rate of 20° C./sec or more.

Herein, if the temperature to heat the blank is below 820° C., a ferrite phase may be created easily on the surface of the blank due to a temperature drop below Ar3 according to natural cooling during the time lapse between extraction and transfer to the die, which may disadvantageously reduce the strength of the final parts. Conversely, if the temperature is too high, the coarsening of austenite grain size occur as well high energy consumption, the effect of grain size refinement cannot be expected furthermore, and the creation of scale defects such as blister on the surface or non-homogeneity by the extra oxidation of the coating layer may problematically occur.

Herein, the blank is preferably held at the heating temperature for 60 seconds or more. This is for soaking treatment to homogenize the temperature of the entire blank. If the holding time is too short, it is difficult to obtain the temperature-homogenizing effect of the blank. Conversely, it is not essentially required to determine the upper limit of the holding time for the purpose of temperature-homogenizing of the blank because one skilled in the art can properly change and adapt it according to the situations.

Further, the cooling rate is for evolving the martensite structure at maximum in the hot press formed part so as to secure the strength of the steel sheet. If the cooling rate is low, a undesirable microstructure, such as ferrite or pearlite, is disadvantageously formed. Thus, the cooling rate has to be 20° C./sec or more. Conversely, since as the cooling rate increases, it is easy to generate the martensite structure, and the ultra-high strength is obtained throughout the parts, there is no need to determine the upper limit of the cooling rate. However, because to realize the cooling rate of 300° C./sec or more is practically very difficult, requires additional equipment, and is uneconomic, the upper limit of the cooling rate can be determined as 300° C./sec.

Another method of manufacturing parts from the steel sheet for forming may be a method of post-heat treatment after cold-forming. The method includes the steps of: preparing a blank or a tube made of the steel sheet for forming according to the present invention; cold-forming the prepared blank or tube to manufacture the same into the shape of parts; heating the manufactured parts at a temperature from 820 to 950° C.; holding the heated parts for 60 seconds or more and extracting the same; and cooling the extracted parts to the temperature of 200° C. or less at a cooling rate of 20° C./sec or more.

Here, the heating temperature, the holding timer and the cooling rate of parts are restricted for the same reasons as those in the hot press forming, the detailed description will be omitted. However, in the process of post-heat treatment after the cold rolling, unlike the hot press forming, the die quenching may be not carried out, but a method is adopted in which parts are brought into contact with coolant, having adequate temperature and specific heat. The determination and the contact method of the coolant will not be described because one skilled in the art can easily select and adopt such items from the prior technology.

The parts of the present invention, manufactured from the above process (hot press forming or post-heat treatment after cold forming), have the microstructure, consisting one or more of martensite of 90% or more by area fraction, and bainite or ferrite. Here, the content of the martensite may be of 90% or more, preferably, but may be of 100%, which means full martensite phase. Further, the parts are of ultra-high strength (tensile strength) of 1470 MPa or more, preferably. Furthermore, the parts have the bake hardenability of approximately 100 MPa or more after baking treatment according to the composition of the present invention.

EXAMPLES

Hot rolled steel sheets were prepared by hot-rolling a steel slab having the composition as reported in Table 1 according to the conditions reported in Table 2, followed by coiling at 650° C. From the hot rolled steel sheets, which were pickled and were then cold rolled at a reduction ratio of 50%, cold rolled, aluminized and galvanized steel sheets were manufactured under the conditions as reported in Table 2. In final product blocks of Table 2, HR indicates hot rolled steel sheet, CR indicates cold rolled steel sheet, Al indicates aluminum coated steel sheet, and Zn indicates galvannealed steel sheet.

The cold rolled steel sheets were manufactured by annealing at a temperature reported in Table 2, followed by slow cooling to 650° C. at a cooling rate from 3 to 6° C./sec, cooling to a temperature range from 400° C. to 550° C. at a cooling rate 7° C./sec, and then over-aging.

The galvannealed steel sheets were manufactured by annealing the cold rolled steel sheets at the foregoing annealing temperature, followed by slow cooling to 650° C. at a cooling rate from 3 to 6° C./sec, cooling to 500° C. at a cooling rate 7° C./sec, immersion into a hot-dip Zinc bath maintained at 460° C., and then alloying treatment at 490° C.

Separately from the galvannealed steel sheets, the aluminum coated steel sheets were manufactured by annealing at 810° C., followed by immersion into a melted aluminum bath maintained at 680° C., and then cooling at a cooling rate from 8 to 15° C./sec. The coating thickness were from 26 to 33 μm with some variations according to the location of the sheets.

TABLE 1

| | Chemical ingredient (wt %, N and B are expressed as ppm) | | | | | | | | | | | | | |
|---|---|---|---|---|---|---|---|---|---|---|---|---|---|---|
| | C | Si | Mn | P | S | Al | B | N | W | Ti | Other | Ti/N | Ceq | Ar3 |
| CS(A) | 0.22 | 0.25 | 1.21 | 0.016 | 0.003 | 0.033 | 25 | 21 | — | 0.025 | 0.20Cr | 3.481 | 0.47 | 740 |
| IS 1 | 0.24 | 0.23 | 1.72 | 0.015 | 0.004 | 0.035 | 15 | 130 | 0.025 | 0.023 | — | 0.517 | 0.54 | 696 |
| CS(B) 1 | 0.221 | 0.25 | 2.3 | 0.01 | 0.003 | 0.035 | 8 | 120 | 0.028 | 0.02 | — | 0.487 | 0.61 | 656 |
| IS 2 | 0.27 | 0.2 | 1.55 | 0.015 | 0.003 | 0.02 | 10 | 190 | 0.032 | 0.022 | — | 0.339 | 0.54 | 700 |
| CS(B) 2 | 0.14 | 0.15 | 2 | 0.011 | 0.0021 | 0.02 | 50 | 133 | 0.033 | 0.01 | — | 0.22 | 0.48 | 704 |
| CS(B) 3 | 0.18 | 0.15 | 1.4 | 0.012 | 0.0021 | 0.026 | 21 | 122 | 0.023 | 0.023 | — | 0.551 | 0.42 | 740 |
| CS(B) 4 | 0.239 | 0.22 | 1.72 | 0.015 | 0.003 | 0.029 | 90 | 25 | 0.026 | 0.03 | — | 3.508 | 0.53 | 696 |
| CS(B) 5 | 0.2 | 0.29 | 2.55 | 0.16 | 0.0011 | 0.035 | 13 | 150 | 0.03 | 0.033 | — | 0.643 | 0.64 | 642 |
| IS 3 | 0.24 | 0.25 | 1.7 | 0.015 | 0.005 | 0.035 | 15 | 130 | 0.058 | 0.025 | | 0.562 | 0.53 | 697 |
| IS 4 | 0.22 | 0.31 | 1.77 | 0.009 | 0.0019 | 0.034 | 15 | 156 | 0.022 | 0.032 | 0.045V | 0.6 | 0.53 | 698 |
| IS 5 | 0.23 | 0.31 | 1.77 | 0.009 | 0.0019 | 0.034 | 15 | 156 | 0.022 | 0.01 | 0.43Nb | 0.187 | 0.54 | 694 |
| IS 6 | 0.23 | 0.17 | 1.63 | 0.015 | 0.0023 | 0.019 | 8 | 130 | 0.015 | 0.019 | 0.70Cu, 0.33Ni | 0.427 | 0.52 | 674 |
| IS 7 | 0.25 | 0.1 | 1.85 | 0.015 | 0.0011 | 0.021 | 15 | 62 | 0.011 | 0.023 | — | 1.085 | 0.56 | 682 |
| IS 8 | 0.241 | 0.2 | 1.71 | 0.011 | 0.0015 | 0.015 | 10 | 75 | 0.028 | 0.015 | — | 0.585 | 0.53 | 696 |
| IS 9 | 0.262 | 0.23 | 1.65 | 0.009 | 0.001 | 0.012 | 12 | 91 | 0.024 | 0.01 | — | 0.321 | 0.54 | 695 |

Note)
CS(A): conventional steel,
IS: inventive steel,
CS(B): comparative steel

TABLE 2

| | | | Hot rolling condition | | | Cold rolling condition | | | Al plating condition | |
|---|---|---|---|---|---|---|---|---|---|---|
| | | Final product | SHT (° C.) | FRT ((C.) | T of HRS (mm) | T of CRS (mm) | AT ((C.) | OAT ((C.) | AT ((C.) | CRAP ((C.) |
| CS(A) | CE(A) 1 | CR | 1200 | 870 | 2.4 | 1.2 | 810 | 500 | — | — |
| | CE(A) 2 | CR | 1200 | 870 | 2.4 | 1.2 | 810 | 500 | — | — |
| IS 1 | IE 1 | CR | 1200 | 875 | 2.4 | 1.2 | 810 | 500 | — | — |
| | IE 2 | CR | 1200 | 875 | 2.4 | 1.2 | 810 | 450 | — | — |
| | IE 3 | CR | 1200 | 875 | 2.4 | 1.2 | 810 | 550 | — | — |
| IS 1 | CE(B) 1 | CR | 1200 | 875 | 2.4 | 1.2 | 810 | 500 | — | — |
| | CE(B) 2 | CR | 1200 | 875 | 2.4 | 1.2 | 810 | 400 | — | — |
| | IE 4 | HR | 1200 | 875 | 2.4 | — | — | — | — | — |
| | IE 5 | Al | 1200 | 875 | 2.4 | 1.2 | — | — | 810 | 8 |
| | IE 6 | Al | 1200 | 875 | 2.4 | 1.2 | — | — | 810 | 15 |
| | IE 7 | Zn | 1200 | 875 | 2.4 | 1.2 | 810 | 500 | — | — |
| CS(B) 1 | CE(B) 3 | Al | 1170 | | 2.4 | 1.2 | — | — | 810 | 15 |
| | CE(B) 4 | CR | 1170 | | 2.4 | 1.2 | 810 | 500 | — | — |
| | CE(B) 5 | CR | 1170 | | 2.4 | 1.2 | 810 | 500 | — | — |
| IS 2 | IE 8 | HR | 1170 | 860 | 2.4 | — | — | — | — | — |
| | IE 9 | CR | 1170 | 860 | 2.4 | 1.2 | 810 | 500 | — | — |
| CS(B) 2 | CE(B) 6 | HR | 1200 | 888 | 2.0 | — | — | — | — | — |
| CS(B) 3 | CE(B) 7 | CR | 1200 | 876 | 4.0 | 2.0 | 810 | 500 | — | — |
| CS(B) 4 | CE(B) 8 | CR | 1200 | 889 | 3.0 | 1.5 | 810 | 500 | — | — |
| CS(B) 5 | CE(B) 9 | CR | 1200 | 884 | 3.0 | 1.5 | 810 | 500 | — | — |
| | CE(B) 10 | Al | 1200 | 884 | 3.0 | 1.5 | — | | 810 | 8 |
| IS 3 | IE 10 | CR | 1200 | 876 | 3.0 | 1.5 | 810 | 500 | — | — |
| | IE 11 | Zn | 1200 | 876 | 3.0 | 1.5 | 810 | 500 | | |
| IS 4 | IE 12 | CR | 1200 | 878 | 2.4 | 1.2 | 810 | 500 | — | — |
| IS 5 | IE 13 | CR | 1230 | 888 | 2.4 | 1.2 | 810 | 500 | — | — |
| IS 6 | IE 14 | CR | 1200 | 890 | 2.4 | 1.2 | 810 | 500 | — | — |
| IS 7 | IE 15 | CR | 1170 | 878 | 3.0 | 1.5 | 810 | 500 | — | — |
| IS 8 | IE 16 | HR | 1180 | 880 | 2.8 | — | — | — | | — |
| | IE 17 | CR | 1180 | 865 | 2.8 | 1.4 | 820 | 500 | | |
| | IE 18 | Al | 1180 | 870 | 2.8 | 1.4 | 820 | 500 | 810 | 9 |

TABLE 2-continued

| | | | Hot rolling condition | | | Cold rolling condition | | | Al plating condition | |
|---|---|---|---|---|---|---|---|---|---|---|
| | | Final product | SHT (° C.) | FRT ((C.) | T of HRS (mm) | T of CRS (mm) | AT ((C.) | OAT ((C.) | AT ((C.) | CRAP ((C.) |
| IS 9 | IE 19 | HR | 1180 | 866 | 3.0 | — | — | — | — | — |
| | IE 20 | Al | 1180 | 850 | 3.0 | 1.5 | 820 | 500 | 810 | 8 |

Note)
SHT: slab heating temperature,
FRT: finish rolling temperature,
T: Thickness,
HRS: hot rolled sheet,
CRS: cold rolled sheet,
AT: annealing temperature,
OAT: over-aging temperature,
CRAP: cooling rate after pot,
CS(A): conventional steel,
CE(A): conventional example,
IS: inventive steel,
IE: inventive example,
CS(B): comparative steel,
CE(B): comparative example In Table 1 above, conventional steel indicates the composition of conventional Cr steel, comparative steel 1 indicates cases in which Mn content is excessive, comparative steel 2 indicates a case in which C content is lower than the range defined by the invention, comparative steel 3 indicates a case in which Mn content is out of the range defined by the invention, comparative steel 4 indicates a case in which N content is out of the upper limit so that Ti/N atom ratio is excessively high, and comparative steel 5 indicates cases in which Mn content is excessively high. Further, conventional steel, comparative steel 2 and comparative steel 3 had a Ceq value lower than the Ceq range defined by the invention, and comparative steel 1 has a Ceq value higher than the Ceq range defined by the invention. Remaining inventive steels 1 to 9 have a composition satisfying the composition range defined by the invention, in which the Ti/N atom ratio, Ceq range and Ar3 conditions are satisfied.

Hot press forming simulation was carried out on hot rolled steel sheets HR, cold rolled steel sheets CR, aluminum coated steel sheets Al and galvannealed steel sheets Zn under the conditions reported in Table 3, and tensile properties before and after the pressing were examined. The tensile properties were evaluated by preparing tensile specimens conforming to JIS #5.

The hot press forming simulation was performed by heating at a heating rate 10° C./sec, followed by heating to a heating temperature reported in Table 3, holding at the heating temperature for 5 mins, air cooling for 14 secs, and then cooling at an average cooling rate 70° C./sec. In order to evaluate increase in yield strength after baking, samples having a hot press forming thermal history were heat treated at 170° C. for 20 mins without being deformed, and then bake hardenability BHo was evaluated. In Table 3 below, YS indicates yield strength, TS indicates tensile strength, El indicates elongation, and BHo indicates bake hardening value measured at pre-strain zero. Here, all of YS, TS and BHo are expressed as MPa, and El is expressed as percent (%).

TABLE 3

| | | Sheet type | T of sheet (mm) | Before HPF YS | Before HPF TS | Before HPF EL | Heating temp (□) | After HPF YS | After HPF TS | After HPF EL | After HPF BHo |
|---|---|---|---|---|---|---|---|---|---|---|---|
| CS(A) 1 | CE(A) 1 | CR | 1.2 | 388 | 564 | 26.6 | 900 | 1120 | 1494 | 8.6 | 88 |
| | CE(A) 2 | CR | 1.2 | 388 | 564 | 26.6 | 850 | 1070 | 1370 | 10.3 | 69 |
| IS 1 | IE 1 | CR | 1.2 | 421 | 611 | 23.6 | 900 | 1222 | 1552 | 7.9 | 150 |
| | IE 2 | CR | 1.2 | 440 | 638 | 22.6 | 830 | 1200 | 1577 | 7.5 | 143 |
| | IE 3 | CR | 1.2 | 389 | 589 | 25.0 | 900 | 1170 | 1520 | 7.7 | 118 |
| | CE(B) 1 | CR | 1.2 | 421 | 611 | 23.6 | 800 | 1050 | 1320 | 8.0 | 133 |
| | CE(B) 2 | CR | 1.2 | 555 | 782 | 18.3 | 900 | 1330 | 1630 | 6.8 | 155 |
| | IE 4 | HR | 2.4 | 384 | 590 | 24.9 | 850 | 1150 | 1501 | 8.9 | 141 |
| | IE 5 | Al | 1.2 | 369 | 625 | 26.0 | 870 | 1231 | 1622 | 7.6 | 167 |
| | IE 6 | Al | 1.2 | 582 | 739 | 22.1 | 870 | 1222 | 1630 | 7.4 | 150 |
| | IE 7 | Zn | 1.2 | 400 | 623 | 25.0 | 870 | 1176 | 1598 | 7.3 | 156 |
| CS(B) 1 | CE(B) 3 | Al | 1.2 | 560 | 920 | 19.2 | 900 | 1160 | 1565 | 7.1 | 176 |
| | CE(B) 4 | CR | 1.2 | 489 | 769 | 20.0 | 800 | 1248 | 1610 | 6.4 | 157 |
| | CE(B) 5 | CR | 1.2 | 489 | 769 | 20.0 | 750 | 1011 | 1200 | 7.9 | 110 |
| IS 2 | IE 8 | HR | 2.4 | 428 | 639 | 22.4 | 930 | 1222 | 1633 | 7.8 | 141 |
| | IE 9 | CR | 1.2 | 444 | 655 | 20.3 | 870 | 1256 | 1640 | 7.4 | 165 |
| CS(B) 2 | CE(B) 6 | HR | 2.0 | 388 | 589 | 24.6 | 900 | 1057 | 1320 | 8.0 | 141 |
| CS(B) 3 | CE(B) 7 | CR | 2.0 | 360 | 535 | 29.0 | 900 | 1034 | 1350 | 9.9 | 121 |
| CS(B) 4 | CE(B) 8 | CR | 1.5 | 440 | 645 | 22.4 | 900 | 1238 | 1651 | 7.7 | 77 |
| CS(B) 5 | CE(B) 9 | CR | 1.5 | 511 | 790 | 18.8 | 850 | 1321 | 1700 | 6.1 | 152 |
| CS(B) 5 | CE(B) 10 | Al | 1.5 | 555 | 898 | 16.0 | 900 | 1321 | 1678 | 7.3 | 167 |

TABLE 3-continued

| | | Sheet type | T of sheet (mm) | Before HPF YS | Before HPF TS | Before HPF EL | Heating temp (□) | After HPF YS | After HPF TS | After HPF EL | After HPF BHo |
|---|---|---|---|---|---|---|---|---|---|---|---|
| IS 3 | IE 10 | CR | 1.5 | 444 | 654 | 22.9 | 870 | 1292 | 1650 | 6.9 | 158 |
| | IE 11 | Zn | 1.5 | 431 | 633 | 23.5 | 870 | 1278 | 1611 | 7.0 | 139 |
| IS 4 | IE 12 | CR | 1.2 | 510 | 630 | 22.8 | 870 | 1252 | 1600 | 7.0 | 152 |
| IS 5 | IE 13 | CR | 1.2 | 534 | 645 | 21.9 | 870 | 1310 | 1642 | 6.7 | 159 |
| IS 6 | IE 14 | CR | 1.2 | 516 | 688 | 21.6 | 870 | 1269 | 1605 | 7.4 | 152 |
| IS 7 | IE 15 | CR | 1.2 | 412 | 600 | 23.8 | 900 | 1187 | 1569 | 7.7 | 104 |
| IS 8 | IE 16 | HR | 2.8 | 432 | 600 | 22.7 | 870 | 1199 | 1587 | 8.3 | 111 |
| | IE 17 | CR | 1.4 | 400 | 593 | 23.0 | 870 | 1222 | 1550 | 6.9 | 132 |
| | IE 18 | Al | 1.4 | 433 | 622 | 22.4 | 870 | 1233 | 1594 | 6.7 | 136 |
| IS 9 | IE 19 | HR | 3.0 | 370 | 585 | 24.6 | 870 | 1199 | 1570 | 8.6 | 142 |
| | IE 20 | Al | 1.5 | 399 | 603 | 23.0 | 870 | 1231 | 1580 | 7.0 | 156 |

Note)
HPF: hot press forming,
CS(A): conventional steel,
CB(A): conventional example,
IS: inventive steel,
IE: inventive example,
CS(B): comparative steel,
CE(B): comparative example According to the results reported in Table 3 above, in the case where conventional steel was hot press formed, parts having a tensile strength of 1470 Mpa or more was obtained by heating, at 900° C. (conventional example). However, as in conventional example 2, the tensile strength sharply dropped when a very small degree of the heating temperature was lowered. Further, also in the case of inventive steel manufactured according to the conditions of the invention, tensile strength dropped when a heating temperature before hot press forming was lowered as comparative example 1. Then, tensile strength was lower than 1470 Mpa that the invention requires. In the case of comparative example 2, when cold rolling over-aging temperature dropped excessively, the strength of the cold rolled steel sheet did not satisfy the condition of the invention that a tensile strength be 750 Mpa or less.

In the case of comparative steels 1 and 5 with Mn content excessively high and Ceq value exceeding the range of the invention, when a heating temperature before hot press forming was within the range of the invention (comparative examples 3 and 4), the tensile strength of final parts was more excellent that the range of the invention. However, the tensile strength of the aluminum coated steel sheet (comparative example 3) and the cold rolled steel sheet (comparative example 4) before hot press forming was too high, so that a blanking die or a press die was under the risk of damage. Further, comparative example 5 of comparative steel 1 with a low heating temperature was unsuitable since the strength of blank was high and the strength of a final product was lower than 1470 MPa that the invention requires. In the case of comparative steel 2 (comparative example 6) in which C content was lower than the value of the invention, tensile strength did not exceed the value of the invention even though the steel sheet was formed after being heated to a high temperature. Further, comparative steel 3 (comparative example 7), in which Mn content was relatively low, had unsatisfactory tensile strength due to narrow austenite region and poor hardenability of steel even though it was formed by heating at a sufficient temperature. In the case of comparative steel 4 (comparative example 8) with low N content, bake hardening of 77 MPa was insufficient. In the case of comparative steel 5 (comparative examples 9 and 10) with excessive Mn content, a die was in danger of wearing due to excessively high strength of steel sheets.

In the case of the aluminum coated steel sheet, fast cooling rate of the steel sheet, after being passed through the melted aluminum bath, increased the strength of the steel sheet (inventive examples 4-1 and 4-2). In addition, excessive Mn content as is comparative steel 1, also increased the strength of steel sheet, so that a strength not exceeding 750 Mpa, which the invention requires, was not obtained (comparative example 3).

Figure 2:
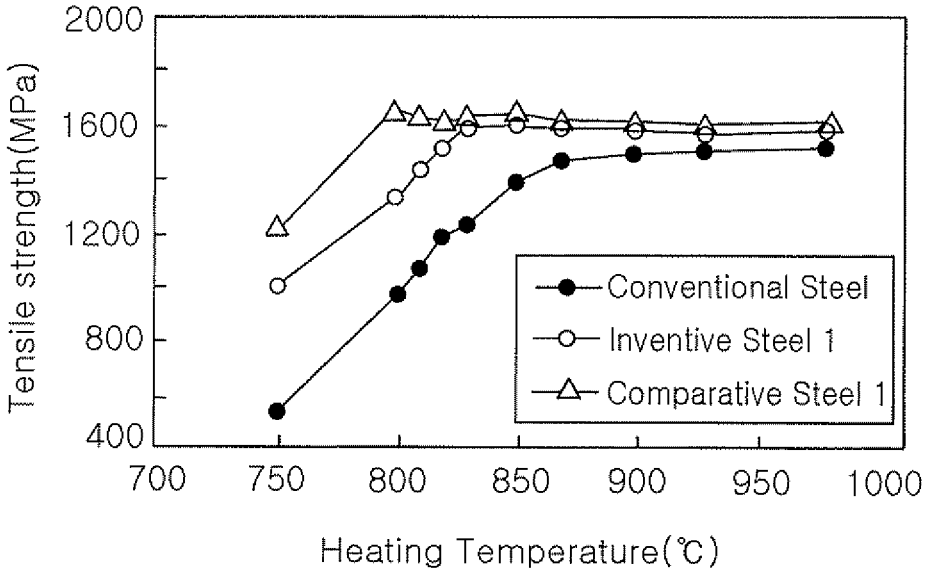
FIG. 2 is a graph showing results of comparing strengths of final parts when conventional steel, inventive steel 1 and comparative steel 1 are subjected to hot press forming at different heating temperatures to manufacture the final parts.

FIG. 2 is a graph illustrates the results of heating conventional steel, inventive steel 1 and comparative steel 1 at their own heating temperature for 5 mins, followed by extraction, air cooling, hot press forming and die quenching. As seen from the graph, conventional steel had strength decrease at a heating temperature not exceeding 870° C., whereas inventive steel 1 and comparative steel 1 had a high tensile strength of 1470 MPa or more even though they were heated at the lower temperature than the heating temperature of conventional steel by 50° C. and 70° C., respectively. In the case of comparative steel 1 where Mn content was too high, while the tensile strength thereof after press forming was 1470 MPa or more, as required by the invention, the strength of steel before hot press forming was too high, such that the die was in danger of damage as described above.

Accordingly, the effects of the composition range and the manufacturing method according to the invention were confirmed.

While the present invention has been shown and described in connection with the exemplary embodiments, it will be apparent to those skilled in the art that modifications and variations can be made without departing from the spirit and scope of the invention as defined by the appended claims.

What is claimed is:

1. A steel sheet for hot press forming, comprising: by weight, carbon (C): 0.15 to 0.35%;
silicon (Si): 0.5% or less;
manganese (Mn): 1.5 to 2.2%;
phosphorus (P): 0.025% or less;
sulfur (S): 0.01% or less;
aluminum (Al): 0.01 to 0.05%;
nitrogen (N): 100 to 200 ppm;
titanium (Ti): 0.005 to 0.05%;
tungsten (W): 0.005 to 0.1%; and boron (B): 1 to 50 ppm, wherein Ti/N: less than 1.1, where Ti/N is the atomic ratio of the corresponding elements, Ceq expressed by the following formula ranges from 0.48 to 0.58, and temperature Ar3 ranges from 670° C. to 725° C., wherein the steel sheet has a microstructure consisting of ferrite and pearlite, and wherein the steel sheet exhibits a tensile strength of 750 MPa or less before hot press forming or before cold forming and post heat treatment after cold forming and a tensile strength of 1470 MPa or more after hot press forming or after post heat treatment after cold forming, $$Ceq=C+Si/24+Mn/6+Ni/40+Cr/5+V/14 \quad \text{[Formula]}$$

where C, Si, Mn, Ni, Cr and V indicate the contents (wt %) of the respective elements.

2. The steel sheet of claim 1, further comprising at least one selected from the group consisting of by weight: niobium (Nb): 0.005 to 0.1%; vanadium (V): 0.005 to 0.1%; copper (Cu): 0.1 to 1.0%; and nickel (Ni): 0.05 to 0.5%.

3. The steel sheet for hot press forming of claim 1, wherein a content of manganese (Mn) is 1.55 to 2.2%.

4. The steel sheet of claim 1, wherein the steel sheet is coated with zinc.

5. The steel sheet of claim 1, wherein the steel sheet is coated with aluminum.

6. The steel sheet of claim 1, wherein the atomic ratio of Ti/N is 1.085 or less.

7. The steel sheet of claim 1, wherein Nitrogen (N) is 130 to 200 ppm.

8. A structural part for a motor vehicle, which is manufactured from a steel sheet by hot press forming, or post-heat treatment after cold forming, in which:

the steel sheet has a composition of, by weight, carbon (C): 0.15 to 0.35%, silicon (Si): 0.5% or less, manganese (Mn): 1.5 to 2.2%, phosphorus (P): 0.025% or less, sulfur (S): 0.01% or less, aluminum (Al): 0.01 to 0.05%, nitrogen (N): 100 to 200 ppm, titanium (Ti): 0.005 to 0.05%, tungsten (W): 0.005 to 0.1%, and boron (B): 1 to 50 ppm, wherein Ti/N: less than 1.1, where Ti/N is the atomic ratio of the corresponding elements, Ceq expressed by the following formula ranges from 0.48 to 0.58, and temperature Ar3 ranges from 670° C. to 725° C.;

wherein a final microstructure of the structural part includes, by area fraction, martensite of 90% or more, and the balance of at least one selected from bainite and ferrite, and wherein the structural part has a bake hardenability of 100 MPa or more and a tensile strength of 1470 MPa or more $$Ceq=C+Si/24+Mn/6+Ni/40+Cr/5+V/14 \quad \text{[Formula]}$$

where C, Si, Mn, Ni, Cr and V indicate the contents (wt %) of the respective elements.

9. The structural part of claim 8, wherein the steel sheet structural part is coated with zinc.

10. The structural part of claim 8, wherein the steel sheet structural part is coated with aluminum.

11. The structural part of claim 8, wherein the atomic ratio of Ti/N is 1.085 or less.

12. The structural part of claim 8, wherein Nitrogen (N) is 130 to 200 ppm.

13. A method of manufacturing a hot rolled steel sheet for hot press forming, comprising:

heating a steel slab to a temperature from 1150° C. to 1250° C., the steel slab having a composition of, by weight, carbon (C): 0.15 to 0.35%, silicon (Si): 0.5% or less, manganese (Mn): 1.5 to 2.2%, phosphorus (P): 0.025% or less, sulfur (S): 0.01% or less, aluminum (Al): 0.01 to 0.05%, nitrogen (N): 100 to 200 ppm, titanium (Ti): 0.005 to 0.05%, tungsten (W): 0.005 to 0.1%, and boron (B): 1 to 50 ppm, wherein Ti/N: less than 1.1, where Ti/N is the atomic ratio of the corresponding elements, Ceq expressed by the following formula ranges from 0.48 to 0.58, and temperature Ar3 ranges from 670° C. to 725° C.; and rolling the heated steel slab via a roughing mill process and a finishing mill process to form the steel sheet, wherein the finishing mill process includes:

rolling the steel sheet above Ar3 temperature; and cooling and coiling the steel sheet at a temperature from 600° C. to 700° C., and wherein the steel sheet has a microstructure consisting of ferrite and pearlite, and wherein the steel sheet exhibits a tensile strength of 750 MPa or less before hot press forming or before cold forming and post heat treatment after cold forming and a tensile strength of 1470 MPa or more after hot press forming or after post heat treatment after cold forming, $$Ceq=C+Si/24+Mn/6+Ni/40+Cr/5+V/14 \quad \text{[Formula]}$$

where C, Si, Mn, Ni, Cr and V indicate the contents (wt %) of the respective elements.

14. The method of claim 13, wherein the steel slab further comprises at least one selected from the group consisting of by weight: niobium (Nb): 0.005 to 0.1%; vanadium (V): 0.005 to 0.1%; copper (Cu): 0.1 to 1.0%; and nickel (Ni): 0.05 to 0.5%.

15. The method of claim 13, wherein a content of manganese (Mn) is 1.55 to 2.2%.

16. A method of manufacturing a cold rolled steel sheet for hot press forming, comprising:

pickling a hot rolled steel sheet, the hot rolled steel sheet having a composition of, by weight, carbon (C): 0.15 to 0.35%, silicon (Si): 0.5% or less, manganese (Mn): 1.5 to 2.2%, phosphorus (P): 0.025% or less, sulfur (S): 0.01% or less, aluminum (Al): 0.01 to 0.05%, nitrogen (N): 100 to 200 ppm, titanium (Ti): 0.005 to 0.05%, tungsten (W): 0.005 to 0.1%, and boron (B): 1 to 50 ppm, wherein Ti/N: less than 1.1, where Ti/N is the atomic ratio of the corresponding elements, Ceq expressed by the following formula ranges from 0.48 to 0.58, and temperature Ar3 ranges from 670° C. to 725° C.;

cold-rolling the pickled steel sheet to manufacture full hard steel sheet; and continuously annealing the full hard steel sheet, wherein, the temperature of the continuous-annealing is controlled to be within a range of 750° C. to 850° C., and temperature of a following over aging section is controlled to be within a range of 450° C. to 600° C., and wherein the steel sheet has a microstructure consisting of ferrite and pearlite, and wherein the steel sheet exhibits a tensile strength of 750 MPa or less before hot press forming or before cold forming and post heat treatment after cold forming and a tensile strength of 1470 MPa or more after hot press forming or after post heat treatment after cold forming, $$Ceq=C+Si/24+Mn/6+Ni/40+Cr/5+V/14 \quad \text{[Formula]}$$

where C, Si, Mn, Ni, Cr and V indicate the contents (wt %) of the respective elements.

17. The method of claim 16, wherein the hot rolled steel sheet further comprises at least one selected from the group consisting of by weight: niobium (Nb): 0.005 to 0.1%; vanadium (V): 0.005 to 0.1%; copper (Cu): 0.1 to 1.0%; and nickel (Ni): 0.05 to 0.5%.

18. The method of claim 17, further comprising coating the steel sheet with zinc.

19. The method of claim 18, wherein the coating of the steel sheet with zinc includes one selected from hot-dip galvanizing, galvannealing, zinc or zinc-iron electroplating.

20. The method of claim 16, further comprising coating the steel sheet with zinc.

21. The method of claim 20, wherein the coating of the steel sheet with zinc includes one selected from hot-dip galvanizing, galvannealing, zinc or zinc-iron electroplating.

22. The method of claim 16, wherein a content of manganese (Mn) is 1.55 to 2.2%.

23. A method of manufacturing an aluminum coated steel sheet for hot press forming, comprising:

pickling a hot rolled steel sheet, the hot rolled steel sheet having a composition of, by weight, carbon (C): 0.15 to 0.35%, silicon (Si): 0.5% or less, manganese (Mn): 1.5 to 2.2%, phosphorus (P): 0.025% or less, sulfur (S): 0.01% or less, aluminum (Al): 0.01 to 0.05%, nitrogen (N): 100 to 200 ppm, titanium (Ti): 0.005 to 0.05%, tungsten (W): 0.005 to 0.1%, and boron (B): 1 to 50 ppm, wherein Ti/N: less than 1.1, where Ti/N is the atomic ratio of the corresponding elements, Ceq expressed by the following formula ranges from 0.48 to 0.58, and temperature Ar3 ranges from 670° C. to 725° C.;

cold-rolling the pickled steel sheet to manufacture full hard steel sheet;

annealing the full hard steel sheet at a temperature from 750° C. to 850° C.; and dipping the annealed steel sheet in a hot aluminum or aluminum alloy bath so as to cool the coated steel sheet to room temperature at a cooling rate from 5° C./sec to 15° C./sec, wherein the steel sheet has a microstructure consisting of ferrite and pearlite, and wherein the steel sheet exhibits a tensile strength of 750 MPa or less before hot press forming or before cold forming and post heat treatment after cold forming and a tensile strength of 1470 MPa or more after hot press forming or after post heat treatment after cold forming, $$Ceq=C+Si/24+Mn/6+Ni/40+Cr/5+V/14 \quad \text{[Formula]}$$

where C, Si, Mn, Ni, Cr and V indicate the contents (wt %) of the respective elements.

24. The method of claim 23, wherein the aluminum coated steel sheet further comprises at least one selected from the group consisting of by weight: niobium (Nb): 0.005 to 0.1%; vanadium (V): 0.005 to 0.1%; copper (Cu): 0.1 to 1.0%; and nickel (Ni): 0.05 to 0.5%.

25. A method of manufacturing structural parts for a motor vehicle, comprising:

preparing a blank made of a steel sheet for hot press forming, the steel sheet having a composition of, by weight, carbon (C): 0.15 to 0.35%, silicon (Si): 0.5% or less, manganese (Mn): 1.5 to 2.2%, phosphorus (P): 0.025% or less, sulfur (S): 0.01% or less, aluminum (Al): 0.01 to 0.05%, nitrogen (N): 100 to 200 ppm, titanium (Ti): 0.005 to 0.05%, tungsten (W): 0.005 to 0.1%, and boron (B): 1 to 50 ppm, wherein Ti/N: less than 1.1, where Ti/N is the atomic ratio of the corresponding elements, Ceq expressed by the following formula ranges from 0.48 to 0.58, and temperature Ar3 ranges from 670° C. to 725° C.;

heating the blank at a temperature of 820° C. to 950° C.;

maintaining the heated blank for 60 seconds or more, and extracting the maintained blank;

transferring the extracted blank into a prepared die, and performing the hot press forming; and cooling hot press formed part to a temperature of 200° C. or less at a cooling rate of 20° C./sec or more in the die, wherein a final microstructure of the structural part includes, by area fraction, martensite of 90% or more, and the balance of at least one selected from bainite and ferrite, and wherein the structural part has a bake hardenability of 100 MPa or more and a tensile strength of 1470 MPa or more, $$Ceq=C+Si/24+Mn/6+Ni/40+Cr/5+V/14 \quad \text{[Formula]}$$

where C, Si, Mn, Ni, Cr and V indicate the contents (wt %) of the respective elements.

26. The method of claim 25, wherein the steel sheet for forming further comprises at least one selected from the group consisting of by weight: niobium (Nb): 0.005 to 0.1%; vanadium (V): 0.005 to 0.1%; copper (Cu): 0.1 to 1.0%; and nickel (Ni): 0.05 to 0.5%.

27. A method of manufacturing parts, comprising:

preparing a blank or a tube made of a steel sheet for post-heat treatment, the steel sheet having a composition of, by weight, carbon (C): 0.15 to 0.35%, silicon (Si): 0.5% or less, manganese (Mn): 1.5 to 2.2%, phosphorus (P): 0.025% or less, sulfur (S): 0.01% or less, aluminum (Al): 0.01 to 0.05%, nitrogen (N): 100 to 200 ppm, titanium (Ti): 0.005 to 0.05%, tungsten (W): 0.005 to 0.1%, and boron (B): 1 to 50 ppm, wherein Ti/N: less than 1.1, where Ti/N is the atomic ratio of the corresponding elements, Ceq expressed by the following formula ranges from 0.48 to 0.58, and temperature Ar3 ranges from 670° C. to 725° C.;

cold-forming the prepared blank or tube into a shape of the part;

heating the manufactured part at a temperature of 820° C. to 950° C.;

maintaining the heated part for 60 seconds or more, and extracting the maintained part; and cooling the extracted part to a temperature of 200° C. or less at a cooling rate of 20° C./sec or more, wherein a final microstructure of the structural part includes, by area fraction, martensite of 90% or more, and the balance of at least one selected from bainite and ferrite, and wherein the structural part has a bake hardenability of 100 MPa or more and a tensile strength of 1470 MPa or more, $$Ceq=C+Si/24+Mn/6+Ni/40+Cr/5+V/14 \quad \text{[Formula]}$$

where C, Si, Mn, Ni, Cr and V indicate the contents (wt %) of the respective elements.

28. The method of claim 27, wherein the steel sheet for forming further comprises at least one selected from the group consisting of by weight: niobium (Nb): 0.005 to 0.1%; vanadium (V): 0.005 to 0.1%; copper (Cu): 0.1 to 1.0%; and nickel (Ni): 0.05 to 0.5%.

* * * * *